United States Patent [19]

Mathis et al.

[11] Patent Number: 4,548,507

[45] Date of Patent: Oct. 22, 1985

[54] MIXING APPARATUS FOR THE PRODUCTION OF MIXTURES

[75] Inventors: Paul Mathis, Merdingen; Max Zimmer, Efringen-Kirchen, both of Fed. Rep. of Germany

[73] Assignee: Mathis System-Technik GmbH, Neuenburg, Fed. Rep. of Germany

[21] Appl. No.: 535,369

[22] Filed: Sep. 23, 1983

[30] Foreign Application Priority Data

Oct. 5, 1982 [DE] Fed. Rep. of Germany ..... 3236780

[51] Int. Cl.[4] ..... B28C 5/14; B28C 7/16; B01F 15/02

[52] U.S. Cl. ..... 366/20; 366/27; 366/35; 366/49; 366/50; 366/64; 366/156; 366/186; 366/189; 366/192

[58] Field of Search ..... 366/18, 19, 20, 27, 366/28, 29, 33, 35, 37, 42, 49, 50, 64, 134, 156, 158, 177, 181, 186, 189, 192

[56] References Cited

U.S. PATENT DOCUMENTS

| | | | |
|---|---|---|---|
| 466,751 | 1/1892 | Gardner | 366/192 X |
| 1,622,294 | 3/1927 | Saulnier | 366/27 |
| 1,798,505 | 3/1931 | Straub | 366/49 X |
| 3,617,031 | 11/1971 | Paris | 366/18 |
| 3,885,774 | 5/1975 | Harris et al. | 366/20 |

FOREIGN PATENT DOCUMENTS

| | | | |
|---|---|---|---|
| 286946 | 12/1970 | Austria . | |
| 327966 | 10/1920 | Fed. Rep. of Germany | 366/192 |
| 2033068 | 1/1971 | Fed. Rep. of Germany | 366/19 |
| 2495047 | 6/1982 | France . | |
| 1066599 | 4/1967 | United Kingdom | 366/50 |
| 1191853 | 5/1970 | United Kingdom | 366/156 |

*Primary Examiner*—Philip R. Coe
*Attorney, Agent, or Firm*—Peter K. Kontler

[57] ABSTRACT

Mixing apparatus is provided for the production of mixtures of particulate solids and in particular, for the production of various mortar mixtures. The apparatus includes metering means, control means and transfer means for metering out and introducing predetermined quantities of components into a mixer and thereupon, after mixing, delivering the mixed product into means for loading transportation vehicles. The apparatus has no intermediate containers for storing various mixtures of building materials. A mixer is provided which can be emptied residue-free. A self-cleaning conveying system from the mixer to each transfer device is further provided. The lower wall zone of the mixer can be completely opened for residue-free emptying, the opening angle being greater than the angle of slide of the mixing material or residues thereof in the mixer. Such an opening prevents appreciable residues from being left in the mixer and from contaminating subsequent mixtures.

27 Claims, 5 Drawing Figures

MIXING APPARATUS FOR THE PRODUCTION OF MIXTURES

BACKGROUND OF THE INVENTION

The present invention relates generally to mixing apparatus for producing dry mixtures and, more particularly, to such apparatus for mixing together such mineral, organic and/or plastic materials as dry mortar, concrete, feedstuffs, fertilizers, foodstuffs and the like. The mixing apparatus in a preferred embodiment includes a metering system, a control system and a transfer device to permit the mixed materials to be transported to and located on transportation vehicles.

Mixing machines of the type adapted for use in mixing dry ingredients are well known in the art particularly for use in mixing installations for mixing ready mortar. Such machines include a storage container in the finished material zone thereof. These finished material storage containers or silos must be provided within such installation for each kind of mortar which is to be loaded loose. The use of such silos enables various products to be mixed in succession, each of them being stored in intermediate storage zones in such finished material silos. As a rule, in such installations, associated metering, mixing and transfer devices must be cleaned between each change of product. Intermediate storage in silos means that extra machines must be provided in the zones of the silos. For example, an elevator may be required for raising or lowering the components, and conveying means such as, for example, a conveying screw or the like, extending from each silo to a transfer device may be required for the loading of vehicles.

In the dry mixing of building materials, particularly plasters and mortars, intermediate storage in silos has the considerable disadvantage of increasing the risk of separation since each time the materials being mixed are refilled, the constituent parts of the material, which have various grain sizes, may become separated. Furthermore, each of such intermediate storage containers requires measuring or indicating devices for precisely determining the particular quantity to be loaded, indepedent of the preceding production of the mixture.

OBJECTS AND SUMMARY OF THE INVENTION

It is a primary object of the present invention to provide mixing apparatus which is particularly adapted for mixing together dry components.

It is another object of the present invention to provide such mixing apparatus wherein the amount of component machinery is substantially reduced in comparison with apparatus heretofore used.

It is still another object of the present invention to provide such mixing apparatus which is capable of enabling different mixtures of materials to be loaded at any time onto vehicles in different sequences.

It is yet another object of the present invention to provide such mixing apparatus which has no intermediate storage for completed mixtures.

It is another object of the present invention to provide such mixing apparatus which can be emptied residue-free and which has self-cleaning conveyor means from the mixer to one or more transfer devices.

In accordance with the subject invention, mixing apparatus is provided for the production of dry mixtures, particularly dry mixtures of minerals, organic and/or plastic materials such as, for example, dry mortar, concrete, feedstuffs, fertilizers, foodstuffs or the like. The apparatus includes a metering system, a conveyor system, and transfer means for loading the mixture on transportation vehicles. The apparatus has no intermediate storage means for intermediate storage of the finished mixture but, instead, a mixer which can be emptied residue-free and a self-cleaning conveyor from the mixer to the transfer means.

Such mixer contains no residue after the emptying thereof and thus permits immediate production of new mixtures not contaminated by the residue of any preceding mixture. The same applies to the transportation system from the mixer to the transfer device. Thus, the entire mixing apparatus can load an arriving vehicle as required with a desired product mixture, without the need for intermediate storage containers. This not only eliminates such intermediate containers, but also the charging and emptying systems and quantity-measuring devices thereof. This substantially reduces the investment cost of the apparatus as well as its maintenance costs due to its shorter conveying paths which require reduced drive energy and, correspondingly, wear out less frequently. When compared with mixing apparatus having intermediate containers, such apparatus offers the further advantage that each product mixture is immediately available. Installations utilizing intermediate containers often are unable to offer immediate availability of their products. One of the intermediate containers may have just been emptied, and as such, while the installation is producing another mixture, product may not be available.

It has been found that there is no need in mixing installations for intermediate storage of the ready mixture, such as was heretofore considered absolutely necessary. By use of the subject apparatus, the separation problem previously described is correspondingly reduced.

The emptying opening or outlet of the mixer may be disposed above or in a funnel with a closure for braked and residue-free emptying. A mechanical or pneumatic conveyor, preferably a dust-proof conveyor belt or a pneumatic conveyor channel or the like, can be provided below the funnel.

In a particularly preferred embodiment of the present invention, the conveyor comprises a conveyor screw. A cleaning screw is disposed parallel with the conveyor screw but at a lower level. During cleaning, the cleaning screw is driven preferably in an opposite direction from the conveyor screw and discharges any residue into a waste container or the like. During normal conveying, the conveying screw can deliver the mixed material to its destination. Since, however, the mixing proportions can be changed, it is impossible to completely avoid the presence of residues in the zone of conveying screws. Such residues can, however, be eliminated by conveying in the opposite direction using the cleaning screw. This eliminates the presence of residues of a previous mixture in the conveying zone.

The conveying means can be driven in both directions and act upon at least two transfer devices. As a result, the whole mixing machine may be effectively used since a second vehicle can be moved into the loading position while the preceding vehicle is being loaded.

An essential feature of the subject invention is the mixer which may be emptied residue-free. This permits a very quick changeover to be made from one product mixture to another without the use of intermediate containers. During use, two different mixtures may be produced in succession, since the first mixture is removed from the mixer without residue. This advantage of the mixer is also applicable with regards to other applications. Thus, the construction of the mixer, which enables residue-free emptying in a particularly advantageous and simple manner, is also considered an essential element of the inventive concept of the subject invention.

In order to insure that the mixer may be emptied residue-free without the need to provide special blowing or scraping devices or the like, a substantially horizontally disposed drum-shaped charge mixer is provided, the lower wall zone of which can be completely opened for emptying. The opening angle of the lower wall zone is greater than the angle of slide of the material for mixing. In a charge mixer of this type, if the lower wall is opened or otherwise removed, all the material for mixing slides out due to the angular relationships mentioned which prevent it from being even partially retained. If the selected opening angle of the mixer is greater than the angle of slide of the residual mixing material which remains between the wall and mixing vanes of the mixer during mixing, particularly reliable residue-free emptying is possible.

In one possible embodiment of the invention, the lower wall zone of the mixer may be closed by the use of at least one and preferably two flaps or other similar closures, which can be pivoted away from one another. This allows a very simple downward opening which permits a major portion of the contents of the mixer to be released in a downward direction. Even the lateral residue of the material cannot be retained in a drum-shaped mixer, since it cannot become sufficiently stably lodged. The lower opening zone may, for example cover substantially one third of the total mixer periphery and is preferably centrally located. The lower zone of the mixer wall adjacent to but not a part of the closure or closures for the aperture is sufficiently steep that not even small residues of a dry mixture can be retained therein.

Advantageously, each hinge of the lower opening flaps is disposed on the outside of the generated surface of the mixer. The corresponding fittings are disposed on the outside of the opening flaps which form the lower part of the mixer wall. Thus, no projections or the like are formed inside the mixer to which small residues of material might possibly adhere. In the closed position, the inside of the opening flaps can be flush with the inside of the mixer wall. Furthermore, each flap, being a continuation of the mixer wall, can have the same radius of curvature and, when in the closed position, the same center of curvature as the mixer inside wall. As such, during the mixing operation, no irregularities occur inside the charge mixer which might have an unfavorable effect on the mixing operation.

The overall result is an inexpensive mixing apparatus which requires less machinery and therefore takes up less space than conventional apparatus. The associated charge mixer has a construction which enables it to be emptied, residue-free, without the need for special systems. The whole apparatus, including the charge mixer, is therefore ready to produce a fresh mixture, and even a different mixture than the preceding mixture immediately after each emptying. Since the particular quantity introduced into the charge mixer is precisely determined, vehicles may be loaded therefrom with corresponding precision.

The novel features which are considered as characteristic of the invention are set forth in particular in the appended claims. The subject apparatus itself, however, both as to its construction and its mode of operation, together with additional features and advantages thereof, will be best understood upon perusal of the following detailed description of certain specific embodiments with reference to the accompanying drawings.

DESCRIPTION OF THE PREFERRED EMBODIMENTS

Figure 1:
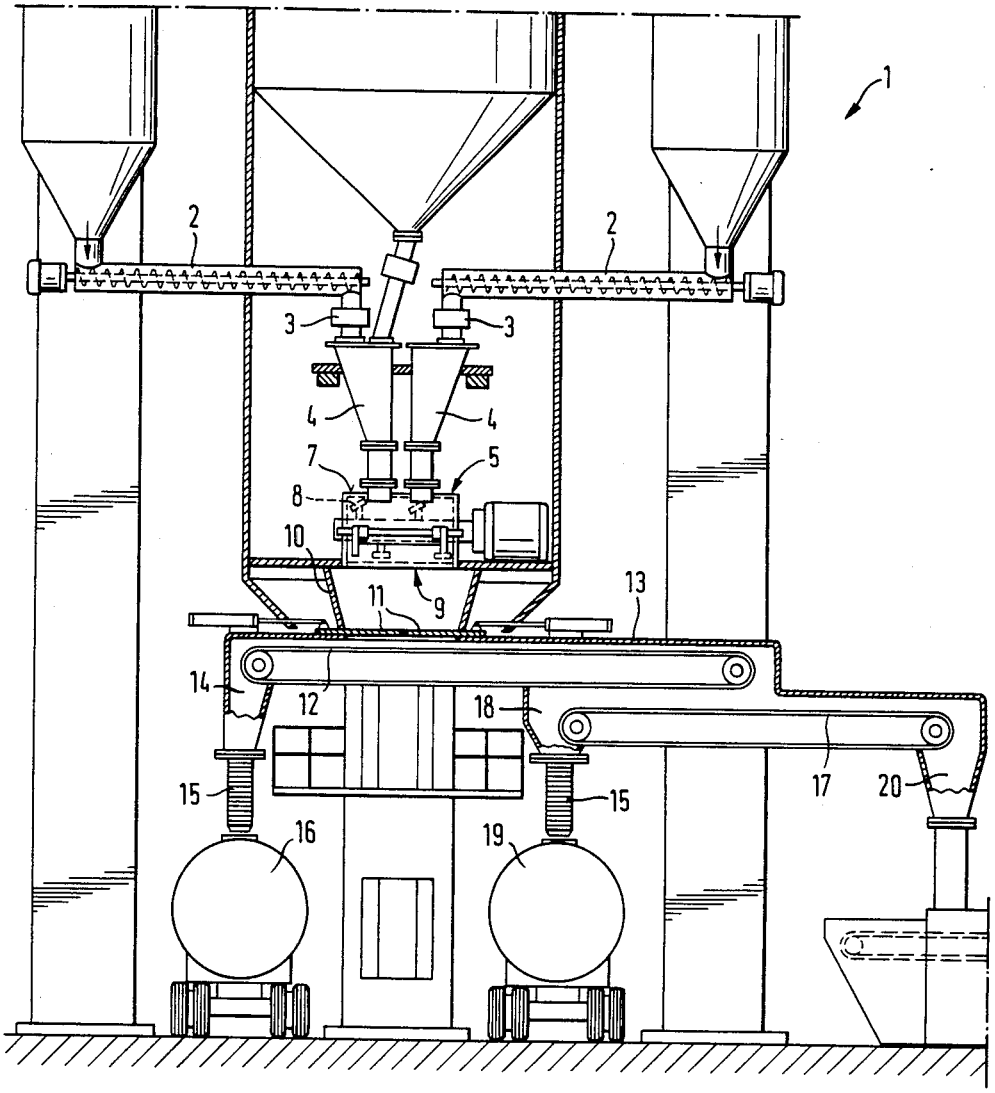
FIG. 1 shows, in partial longitudinal section, a mixing machine according to the invention with space for two or more vehicles to be loaded therefrom.

The mixing apparatus 1 of the subject invention has a pair of metering systems 2 which are adapted to meter out various components of the mixture in predetermined requisite quantities from corresponding containers. The metered out components then pass through a pair of controls 3 and funnels 4, and are introduced into a mixer 5 which will be described in greater detail hereinafter.

One characteristic of the mixing apparatus 1 of the present invention is that no type of intermediate container is provided into which the finished mixture can be introduced. Mixer 5 is a horizontally disposed, drum-shaped charge mixer which may be emptied residue-free. The lower wall zone of the mixer 5, which is shown in greater detail in FIGS. 2 and 3, can be completely opened for emptying. When such lower wall zone is opened, the resultant emptying angle is greater than the angle of slide of the material for mixing. As such, during emptying of the mixer contents of mixer 5, the material is prevented from being trapped in the mixer 5. As a result, different mixer compositions can be introduced and mixed without having to clean the mixer between operations. Thus, one is able to continuously use the mixer 5 for mixing charges of different ingredients one after another since all one need do is to change over the metering and control systems without having to clean the mixer 5 between charges. This obviates the need for intermediate containers for intermediate storage of the various mixtures.

Figure 3:
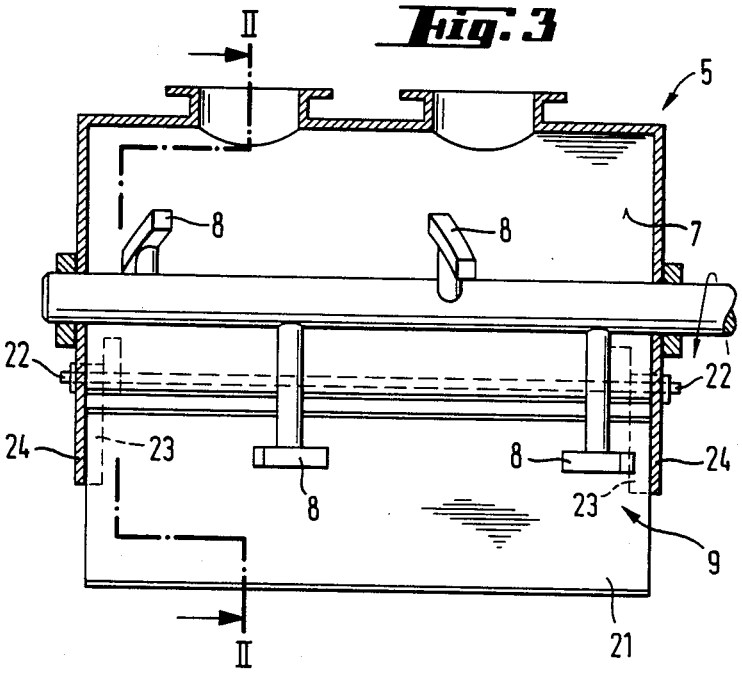
FIG. 3 is a longitudinal sectional view of the charge mixer of the subject invention which permits residue-free emptying.
Figure 2:
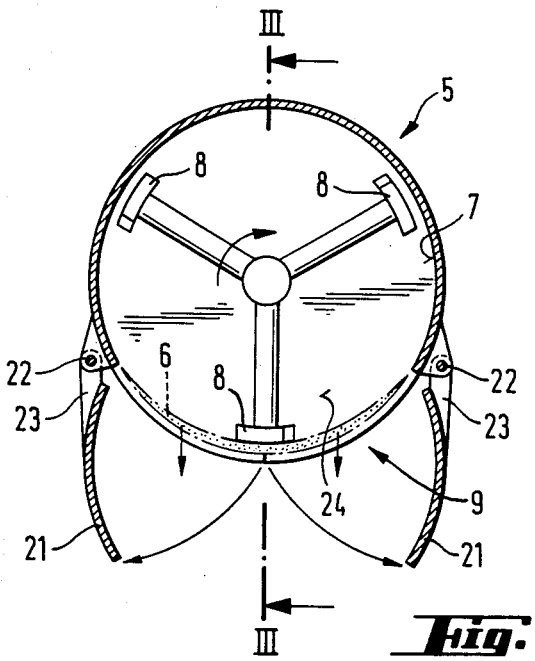
FIG. 2 is an enlarged cross-sectional view thereof.

The relationship of the opening angle of the charge mixer 5, i.e., the angle formed when the lower end of the mixer 5 is opened, and the angle of slide of the residual mixing material 6 which tends to be trapped between the wall 7 and the mixing vanes 8 is shown in greater detail in FIGS. 2 and 3.

The relationship of the mixer 5 to subsequent operations of the apparatus is shown in FIG. 1. The emptying opening 9 of the mixer 5 is positioned directly above or actually in a funnel 10. A closure 11 is provided for braked emptying, and a conveyor belt 12, preferably a dustproof conveyor belt, is provided below the funnel 10 for transporting the mixed contents to subsequent operating steps. FIG. 1 also shows somewhat diagrammatically the jacket 13 of the conveyor belt 12. The funnel 10 is adapted to receive the contents of the charge mixer 5, so that the mixing material can be slowly transferred to the conveyor belt 12.

In the embodiment illustrated in FIG. 1, the conveyor belt 12 can be driven in both directions to permit delivery to either of two transfer devices 14, 18. In the left-hand portion of FIG. 1, a direct transition from the conveyor belt 12 to the transfer device 14 is illustrated with the mixed material adapted to be introduced into filling spout 15 for delivery or loading into a vehicle 16. The right-hand portion of the conveyor belt 12 is adapted to discharge over a second conveyor belt 17 which also operates in two directions and which can deliver mixed material to two delivery devices, namely, the second transfer device 18 with filling spout 15 for loading a vehicle 19, and a transfer station 20 where the mixing material can be conveyed to subsequent operational stages.

The lower zone of the wall of the mixer 5 is closed by the use of at least one and preferably two flaps 21 or other similar closures. As shown in FIGS. 2 and 3, two flaps 21 are preferably provided which are adapted to be pivoted away from one another. The lower opening zone comprises substantially one third of the total mixer periphery and is centrally disposed. It will be appreciated that the inside cylindrical wall 7 of the mixer 5 immediately adjoining the flaps 21 is so steep that the dry material being mixed cannot collect or otherwise be retained in the mixer 5 once the flaps 21 are opened due to the gravitational effect drawing the material downwardly and out of the mixer. Heretofore, mixers had small lower zone openings which resulted in the residual mixing material becoming entrapped in the mixer thereby necessitating removal thereof with special tools and/or compressed air.

Due to the large size of the opening 9, it is necessary to reinforce the mixing casing by the use of hinges 22 which extend longitudinally along the extent of the opening 9 and can serve to reinforce the mixer 5. Alternatively, reinforcing materials may be provided about the opening 9 or about the hinges 22 mounted thereon. The hinges 22 are disposed on the outer casing or surface of the mixer 5, and corresponding fittings 23 disposed on the outside of the flaps 21 are used to connect the hinges 22 to the flaps 21 which form the lower part of the mixer wall. If necessary in order to further reinforce the mixer 5, particularly in the zone of its large opening 9, parts corresponding to the fittings 23 can be provided on the mixer 5 itself.

The opening flaps 21 of the mixer 5 are so constructed that in a closed position their inside surfaces are flush with the inside wall 7 of the mixer 5 and serve as a continuation of the mixer wall 7. To this effect, they have the same radius of curvature as the inside wall 7, and in a closed position, the same center of curvature as the mixer wall 7 itself.

FIG. 3 illustrates the extent of the opening 9 which is defined by flaps 21. The opening 9 is bounded at either end by the end walls 24 of the mixer 5 which form the front and rear boundaries of the opening 9. Due to such construction, the formation of an edge or shoulder at the transition of the opening 9 is avoided thus preventing even small quantities of mixing material from becoming entrapped and contaminating the next charge which may have different mixing ratios and components.

In summary, the invention provides a mixer 5 of relatively simple design which, by virtue of its large opening alone, can be emptied of residues without special tools. This in and of itself, represents a great advantage over the prior art for different applications. However, it is particularly advantageous to use the mixer 5 in the mixing apparatus 1 since, as a result, the mixing machine can be economically changed over, practically without transition and without intermediate storage, from one mixture to another. This permits the filling of vehicles 16 and 19 in succession with different mixtures, without the need for the aforementioned intermediate storage. The result is that the entire mixing apparatus 1 may be constructed in a simpler and less expensive manner.

Figure 4:
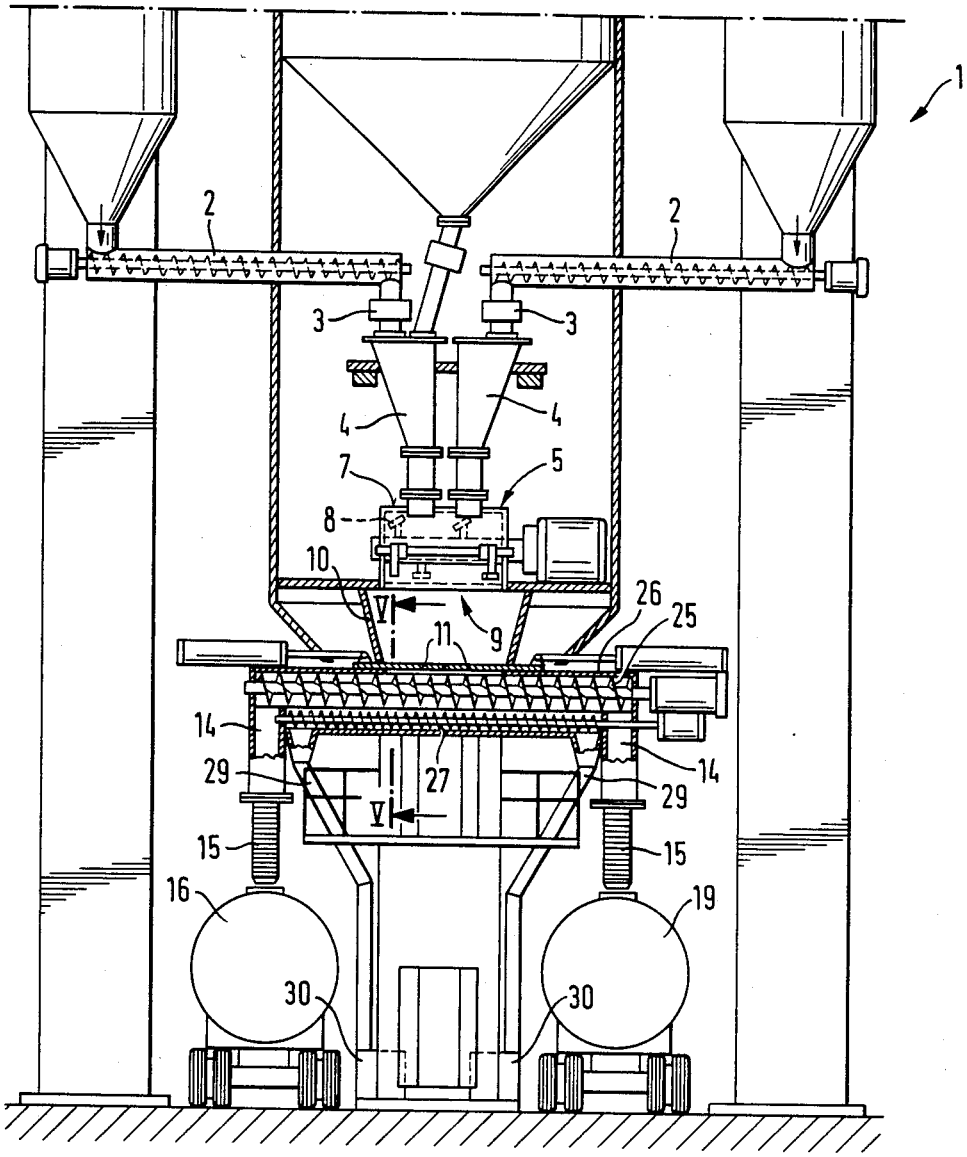
FIG. 4 illustrates an alternative embodiment of the mixing machine of FIG. 1 wherein a conveying screw with a parallel cleaning screw is provided below the charge mixer.
Figure 5:
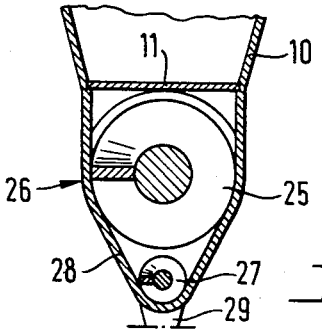
FIG. 5 is an enlarged cross-sectional view taken through the zone of the conveying screw with the cleaning screw.

FIGS. 4 and 5 show an alternative embodiment of the mixing apparatus 1 of FIGS. 1–3 wherein a conveying screw 25 is used as the conveying means. The conveying screw 25 is disposed inside a dust proof casing 26 positioned below the funnel 10 into which the mixer 5 is emptied. In the embodiment of FIGS. 4–5, the conveying screw 25 is capable of delivering mixed material to at least two transfer devices 14 for loading at least two vehicles 16 and 19. As a result, the advantages of a conveying screw 25 can be used in this zone of the mixing apparatus 1.

It is found, however, that when rotation of the conveying screw 25 is stopped, material from the conveying and mixing operations becomes entrapped below the conveying screw 25 where a clearance exists. In order to prevent this, a cleaning screw 27 is disposed in a conical zone 28 of the casing 26, parallel with the conveying screw 25 and immediately therebelow. The cleaning screw 27 is adapted to be driven in a direction opposite to the direction of rotation of the conveyor screw for discharging any waste or residue material. This serves to clean or otherwise remove any residue of the conveying screw 25 after mixing.

When a conveying operation to one of the vehicles 16 and 19 has been completed by use of the conveying screw 25 and the mixing apparatus 1 is to be changed over to another type of mixture, the cleaning screw 27 is activated and serves to first convey the residue of the mixture which is in the casing 26 through a pair of discharge pipes 29 provided at opposite ends of the cleaning screw 27. From the pipes 29, the residue is delivered to a waste container 30 which can, if necessary, be movable for filling either vehicle 16,19.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art, and therefore, such adoptations should and are intended to be comprehended within the meaning and range of equivalence of the claims.

We claim:

1. Mixing apparatus for forming successive batches of mixtures containing identical or different types of particulate solids, particularly dry mortar, concrete, feedstuffs, fertilizers, foodstuffs and the like, comprising:

(a) a mixer including at least one mixing element arranged to impart motion to the contents of the mixer, said mixer constituting the sole means for storing the batch of mixture which is formed therein;

(b) metering means for introducing predetermined amounts of selected components to be mixed into said mixer and to be set in motion by said mixing element so that the contents of the mixer are converted into a batch of intermixed components; and (c) self-cleaning conveyor means for transporting the mixture formed in said mixer away from the latter, said mixer including delivery means for discharging the mixture to said conveyor means, and said delivery means being movable between a first position in which said delivery means defines an outlet opening for the mixture, and a second position in which said outlet opening is sealed, said mixer being designed in such a manner that the mixture, including virtually all residues thereof, is discharged from said mixer by gravity in response to movement of said delivery means to said first position so that the apparatus is ready to form a different mixture without appreciable delay following the making of the last batch of a preceding mixture whereby the different mixture is not contaminated or otherwise adversely influenced by the components of the preceding mixture.

2. The apparatus of claim 1 wherein said conveyor means is dustproof.

3. The apparatus of claim 2 wherein said conveyor means comprises a conveyor belt.

4. The apparatus of claim 1 wherein said conveyor means is a pneumatic conveyor channel.

5. The apparatus of claim 1 wherein said conveyor means is a conveyor screw.

6. The apparatus of claim 5 wherein a cleaning screw is provided parallel with said conveyor screw but at a lower level thereto, said cleaning screw being adapted to be driven in a direction opposite to the direction of rotation of the conveyor screw for discharging residues of the mixture.

7. The apparatus of claim 5 wherein a cleaning screw is provided for the conveyor screw.

8. The apparatus of claim 7 wherein the cleaning screw is provided in a conically shaped, narrowed portion of a casing for the screws.

9. The apparatus of claiim 7 wherein the cleaning screw discharges to a waste container.

10. The apparatus of claim 1 wherein said conveyor means adapted to be driven in at least two directions to permit it to convey the mixture to at least two transfer devices.

11. The apparatus of claim 1 wherein said mixer is a substantially horizontally disposed drum-shaped charge mixer.

12. The apparatus of claim 1 wherein said delivery means comprises a lower wall zone of said mixer which is adapted to be completely opened.

13. The apparatus of claim 12 wherein the opening angle of the lower wall zone is greater than the angle of slide of mixture along the interior walls of said mixer.

14. The apparatus of claim 12 wherein said lower wall zone of the mixer includes at least one flap.

15. The apparatus of claim 14 wherein said lower wall zone includes at least two pivotally mounted flaps adapted to swing away from one another to said first position.

16. The apparatus of claim 15 wherein each of said flaps is pivotally attached to said mixer by at least one hinge which is secured to the outside wall of the mixer.

17. The apparatus of claim 16 wherein at least one fitting is provided attaching each hinge to the respective flap.

18. The apparatus of claim 17 wherein said fittings are secured to the outer surfaces of the respective flaps.

19. The apparatus of claim 16 wherein said hinges serve to reinforce the wall of the mixer.

20. The apparatus of claim 15 wherein said flaps are adapted to be flush with the inner surface of the mixer when said flaps are in said second position.

21. The apparatus of claim 20 wherein said mixer has a concave inside wall and each of said flaps has a concave inner surface, the radius of curvature of the inner surface of each flap being the same as the radius of curvature of the inside wall of the mixer.

22. The apparatus of claim 21 wherein the center of curvature of the inner surface of each flap in said second position is the same as the center of curvature of the inside wall of the mixer.

23. The apparatus of claim 12 wherein said lower wall zone is centrally disposed and covers approximately one third of the periphery of the mixer.

24. The apparatus of claim 12 wherein the lower wall zone of said mixer is bounded at its opposite ends by the end walls of the mixer.

25. The apparatus of claim 1 comprising transfer means for delivering the mixture from said conveyor means to transporting vehicles.

26. The apparatus of claim 1 comprising a funnel between said mixer and said conveyor means; and wherein said delivery means is disposed above or in said funnel so that the mixture travels from said mixer to said conveyor means via said funnel, said funnel being designed in such a manner that the mixture, including virtually all residues thereof, travels through and out of said funnel by gravity.

27. The apparatus of claim 26 wherein said funnel includes a closure.

* * * * *